United States Patent [19]

Abramson

[11] Patent Number: 4,660,227

[45] Date of Patent: Apr. 28, 1987

[54] WOMEN'S NURSING WEAR FASHIONS

[76] Inventor: Naomi K. Abramson, 7320 Cirrus Way, Canoga Park, Calif. 91307

[21] Appl. No.: 540,829

[22] Filed: Oct. 11, 1983

[51] Int. Cl.[4] ..... A41D 1/20

[52] U.S. Cl. ..... 2/104

[58] Field of Search ..... 2/104

[56] References Cited

U.S. PATENT DOCUMENTS

| | | | |
|---|---|---|---|
| 1,098,155 | 5/1914 | Knapp | 2/104 |
| 1,206,480 | 11/1916 | Stagg | 2/104 |
| 3,423,761 | 1/1969 | Nickerson | 2/104 |
| 4,004,294 | 1/1977 | Pinch | 2/104 |
| 4,031,566 | 6/1977 | Johnson | 2/104 |
| 4,446,572 | 5/1984 | Lindquist | 2/104 |
| 4,528,699 | 7/1985 | Hughes | 2/104 |

*Primary Examiner*—Doris L. Troutman

[57] ABSTRACT

A woman's nursing-wear garment—a dress, blouse, or nightgown—has horizontal, vertical, or diagonal openings of sufficient dimension to expose the nipple at either breast. These openings in the respective garment, specifically pertaining to the upper front portion, are of an overlap design with the fabric on one side extending over the fabric on the opposite side. This configuration leaves an opening in the form of a slit that can be readily enlarged by separation of the overlapped fabric layers at the area of the breast and nipple, to provide access for nursing. The overlap design may but need not incorporate zippers, buttons, or hook-and-loop-type fasteners. A large additional panel, attached to the respective garment at the shoulder, of coordinated design and color covers the overlap portion of the garment down to the area well below the breasts. It, in turn, provides the necessary privacy while nursing the baby.

18 Claims, 6 Drawing Figures

WOMEN'S NURSING WEAR FASHIONS

FIELD OF THE INVENTION

This invention relates to women's nursing-wear dresses, blouses, and nightgowns. The invention facilitates a mother's nursing of her baby, discreetly and comfortably, whether in public or in private.

BACKGROUND OF THE INVENTION

A recent survey reports that almost two of three new mothers nurse their new babies. Inasmuch as today's woman and mother is more liberated and mobile than ever before, she desires nursing-wear apparel during her period of breastfeeding that allows her the freedom of being in public with her baby for social and domestic purposes, and yet provides the comfort, discreetness, and functional needs of nursing.

She also, however, wants apparel for nursing which is simple in fulfilling its designated purpose, and yet fashionable and available in a variety of styles.

Accordingly, even though nursing clothing has been available in limited style, design and comfort for some years, it has not achieved the multiple goal of (1) functional application in a simple but fully effective manner of nursing the baby in a totally discreet fashion; (2) providing convenient and comfortable styling for a fashion-conscious woman and mother wherever she may be during the day or evening; and (3) allowing the post-nursing mother to continue to wear the apparel without generating attention by virtue of excessive conspicuousness of its former functional purpose.

For example, U.S. Pat. No. 4,446,572 discloses a nursing dress which includes outer and under dress portions. The outer dress portion covering the torso has full-length zippers. The zippers open to expose the respective breasts for nursing. While this idea for nursing is appropriate in a private situation, it does not completely allow for a mother to discreetly nurse her baby in public—for the breast could be exposed before, after and perhaps during the nursing period. Its purpose and design is to hide only the nipple, and only during breastfeeding. In addition, the dress in this above-noted patent is somewhat complicated in its arrangement and use.

Another example, shown in U.S. Pat. No. 4,004,294, is a blouse-only design that has left and right frontal pocket-like panels which are opened to provide for access to the mother's breast for nursing. Again, as in the previous example, the respective breast during nursing is exposed to public view to some extent.

BRIEF DESCRIPTION OF THE PRESENT INVENTION

The present invention fulfills the above-mentioned three goals for a complete nursing-wear wardrobe. With the fulfilling of those three objectives, the present invention offers to nursing mothers a variety of styles of dresses, blouses and nightgowns that are both fashionable and utilitarian in public and in private.

Specifically, this invention provides the chest area of the garment with overlap configurations at each breast, providing openings in the fabric for access to each breast for nursing. The overlap extends over the entire breast area, thereby helping to preserve the modesty of the wearer, and still allows for quick and convenient access for nursing.

The fabric overlap is simply separated with the mother's fingers to expose the breast and nipple.

Depending upon the particular style of the dress, blouse or nightgown, the openings may be arranged in a horizontal, vertical or diagonal configuration. Also, to add variety to nursing-wear fashions, it is feasible to use buttons, zippers or other connecting devices.

The second functional aspect of the garment consists of an additional panel, whose purpose is to cover the breast and nipple from public view while the baby is nursing. The additional panel is attached at the shoulders and then flows unattached, covering the breast area and extending down to various lengths below the breasts. At the time of nursing, the collar serves to cover completely the exposed breast and nipple (and indeed, if desired, the entire head of the baby) in a loose-fitting manner, thereby providing ample air circulation.

All of the foregoing principles and advantages of the present invention will be more fully appreciated upon consideration of the following detailed description, with reference to the appended drawings, of which:

DETAILED DESCRIPTION OF THE PREFERRED EMBODIMENT

Figure 1:
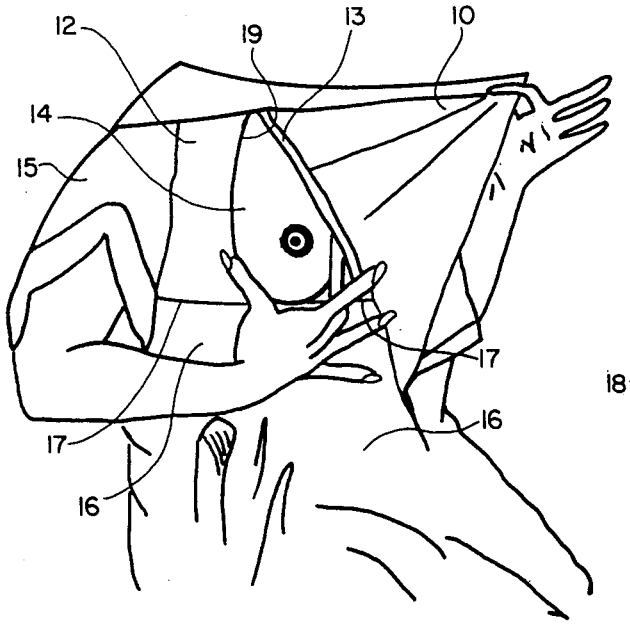
FIG. 1 is a representation of a preferred embodiment of my invention, showing the nursing mother gaining access to and exposing the breast and nipple preparatory to nursing the baby, by separating the overlap. The mother is also shown raising the additional panel, but only for clarity of the illustration.

Referring to FIG. 1 of the drawings, the women's nursing-wear dress is shown to include the front 10 of the additional panel, which is attached to the front portion of the garment only at the shoulders and at the neckline. The additional panel is advantageously of a matching or complementary color and design relative to the main body 16 of the garment. It functions to fully cover the breast area, extending down to an appropriate point below the breasts, as perhaps best conveyed in FIG. 6.

Figure 2:
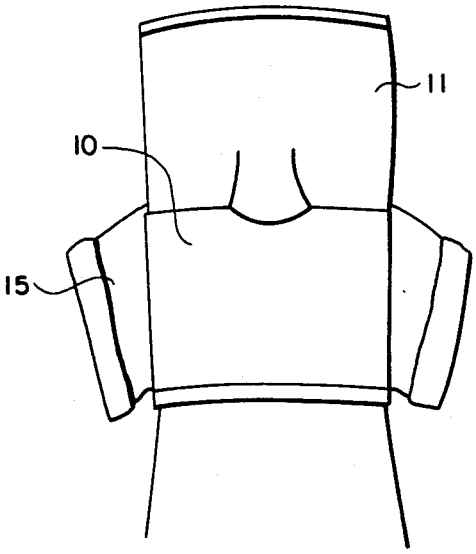
FIG. 2 shows the additional panel of the FIG. 1 embodiment in front of the garment proper, and also shows a rear, auxiliary additional panel.
Figure 6:
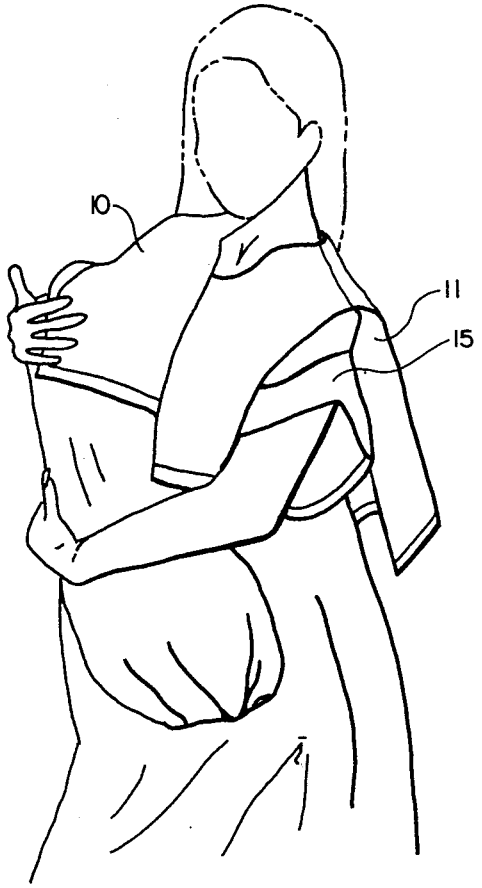
FIG. 6 shows the FIG. 1 embodiment in use during nursing.

The back 11 of the additional panel is optional but desirable in that it serves to complement the front 10, as is indicated in FIGS. 2 and 6, distracting attention to some degree from the functionality of the front 10 of the additional panel.

Referring again to FIG. 1, the garment includes a center-front panel 13 that is attached at the right-hand and left-hand upper lines of attachment 21 to the neckline and inner shoulder of the garment body 16, and at the lower portion as at a lower line of attachment or seam 17 below the breast area.

As is inherent in this structure, this seam 17 may be considerably lower than illustrated—even below the waistline—without departing from the description already given.

Figure 4:
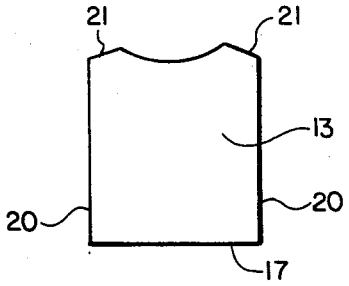
FIG. 4 shows the inside panel of the overlap structure, in the preferred FIG. 1 embodiment.

On either side, this panel extends toward the left and right sides to approximately the center of each breast and is unattached at its sides 20. This center-front panel is also shown in FIGS. 4 and 5.

Figure 3:
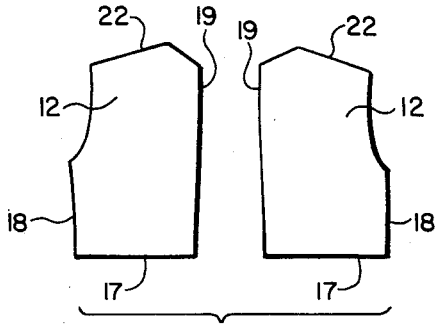
FIG. 3 illustrates the outside portion of the overlap structure of the preferred FIG. 1 embodiment.
Figure 5:
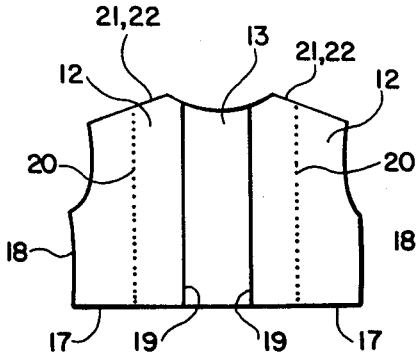
FIG. 5 provides an overview of the two-layer overlap structure, in the FIG. 1 embodiment.

Also referring to FIGS. 1, 3 and 5, the dress includes right-hand and left-hand front panels 12, each attached at its respective right-hand or left-hand upper line of attachment 22 to a shoulder and optionally to a portion of the outer neckline. These two front panels are also attached to the garment body 16 as at the lower seam 17 below the breasts, and down the sides at the outside of each breast as at vertical left-hand and right-hand side lines of attachment or seams 18 under each arm. The inner sides 19 of these two panels are unattached and extend to approximately the inner area of each breast.

The center-front panel 13 overlaps the left- and right-hand panels 12 by approximately three inches, preferably with the center-front panel 13 underneath (i.e., closer to the wearer's body) for greatest privacy, as best shown in FIG. 5. This arrangement allows the nursing woman to gain access to either breast and nipple by simply spreading apart the respective pair of panels to expose the breast and nipple 14. Thus the panels 12 and 13 work in pairs to provide the mother access to the breast for nursing her baby.

FIG. 2 shows how the front 10 and back 11 of the additional panel may be connected together or continuous. The garment may but need not have sleeves 15.

From the above, it can be seen that the present invention provides a woman's nursing-wear garment that is much improved over those in the past. It offers the nursing mother increased convenience, comfort and flexibility, in a configuration that is particularly amenable to fashionable implementation. The greatest possibility of privacy is provided with this invention while allowing maximum fashion.

Many modifications of this invention are possible, such as embodying the above-mentioned access openings for each breast in a horizontal, vertical or diagonal configuration; or the addition of zippers, buttons or other connecting devices to the fashions—which may be, for example, dresses, blouses or nightgowns.

It will be understood that the foregoing disclosure is intended to be merely exemplary, and not to limit the scope of the invention—which is to be determined by reference to the appended claims.

I claim:

1. A garment for use by a woman who is nursing, including, in combination:

(a) a garment body which extends very generally across such woman's back, and in front of her body at or below her abdomen, to define:

right-hand and left-hand upper lines of attachment that are very generally along such woman's two shoulders respectively, a lower line of attachment that is very generally across the front of her body, substantially below the breasts, and right-hand and left-hand side lines of attachment that are very generally along such woman's sides vertically under her arms;

(b) a front under-panel which:

extends vertically between, and is attached to or integral with the garment body along, the upper and lower lines of attachment, extends horizontally between very generally the centers of such woman's breasts, and on its two sides, at least below such woman's shoulders and above the bottom of her breasts, is not permanently attached to the garment body;

(c) right-hand and left-hand front outer panels which:

extend vertically between, and are attached to or integral with the garment body along, the upper and lower lines of attachment, are attached to the garment body along the side lines of attachment, extend horizontally from the side lines of attachment toward one another, overlapping the under-panel on its two sides, and at least below such woman's shoulders and above the bottom of her breasts, are not permanently attached to the garment body and not permanently attached to the under-panel;

said under-panel and outer-panels, where overlapped but not attached, defining right-hand and left-hand generally vertical slits that provide access to such woman's respective breasts and nipples; and (d) a vertically extended additional panel that:

is attached to the garment body or to one or more of the outer-panels and under-panel, generally along the right-hand and left-hand upper lines of attachment, hangs downwardly at least past the bottom of such woman's breasts, and covers such woman's breast and nipple when they are exposed for nursing, therefore providing privacy to such woman during nursing.

2. The garment of claim 1, comprising:

a neckline extending across between the left-hand and right-hand upper lines of attachment.

3. The garment of claim 2, wherein:

the upper edge of the additional panel is positioned generally along the neckline.

4. The garment of claim 2, wherein:

the upper edge of the front-center panel is positioned generally along the neckline.

5. The garment of claim 1, wherein:

the garment body is extended downwardly to form a portion that, in use, hangs below such woman's waist.

6. The garment of claim 5, wherein:

the said extended portion is in the form of a skirt; and the garment is a dress.

7. The garment body of claim 5, wherein:

the said extended portion is in the form of a skirt; and the garment is a nightgown.

8. The garment of claim 1, wherein:

the garment body comprises a waist band that defines the lower line of attachment; and the garment is a blouse.

9. The garment of claim 1, further comprising:

left-hand and right-hand sleeves attached at the rear of the garment to the garment body and at the front of the garment to the upper, outer corners of the respective outer-panels.

10. A garment for use by a woman who is nursing, including, in combination:

(a) a garment body which extends very generally across such woman's back, and in front of her body at or below her abdomen, to define:

right-hand and left-hand upper lines of attachment that are very generally along such woman's two shoulders respectively, a lower line of attachment that is very generally across the front of her body, substantially below her breasts, and right-hand and left-hand side lines of attachment that are very generally along such woman's sides vertically under her arms;

(b) a center-front panel portion of the garment, which:

extends vertically between, and is attached to or integral with the garment body along, the upper and lower lines of attachment, extends horizontally between very generally the centers of such woman's breasts, and on its two sides, at least below such woman's shoulders and above the bottom of her breasts, is not permanently attached to the garment body;

(c) right-hand and left-hand front panel portions of the garment, which:

extend vertically between, and are attached to or integral with the garment body along, the upper and lower lines of attachment, are attached to the garment body along the side lines of attachment, extend horizontally from the side lines of attachment toward one another, and at least below such woman's shoulders and above the bottom of her breasts, are not permanently attached to the garment body and not permanently attached to the center-front panel portion;

said center-front panel portion and the right-hand front panel portion overlapping at the right side of the center-front panel portion, but being unattached defining a right-hand slit that provides access to such woman's right breast and nipple;

said center-front panel portion and the left-hand front panel portion overlapping at the left side of the center-front panel portion, but being unattached defining a left-hand slit that provides access to such woman's left breast and nipple; and (d) a vertically extended additional panel that:

is attached to the garment body or to one or more of the front panel portions, generally along the right-hand and left-hand upper lines of attachment, hangs downwardly at least past the bottom of such woman's breasts, and covers such woman's breast and nipple when exposed for nursing, therefore providing privacy to such woman during nursing.

11. The garment of claim 10, comprising:

a neckline extending across between the left-hand and right-hand upper lines of attachment.

12. The garment of claim 11, wherein:

the upper edge of the additional panel is positioned generally along the neckline.

13. The garment of claim 11, wherein:

the upper edge of the front-center panel is positioned generally along the neckline.

14. The garment of claim 10, wherein:

the garment body is extended downwardly to form a portion that, in use, hangs below such woman's waist.

15. The garment of claim 14, wherein:

the extended portion is in the general form of a skirt; and the garment is a dress.

16. The garment body of claim 14, wherein:

the extended portion is in the general form of a skirt; and the garment is a nightgown.

17. The garment of claim 10, wherein:

the garment body comprises a waist band that defines the lower line of attachment; and the garment is a blouse.

18. The garment of claim 10, further comprising:

left-hand and right-hand sleeves attached at the rear of the garment to the garment body and at the front of the garment to the upper, outer corners of the respective outer-panels.

* * * * *